United States Patent [19]

D'Andrade et al.

[11] 4,193,223

[45] Mar. 18, 1980

[54] INERTIA WHEEL TOY VEHICLE

[75] Inventors: Bruce M. D'Andrade, Flemington, N.J.; Kwok Wa Tsui, WanChai, Hong Kong

[73] Assignee: Arco Industries Ltd., New York, N.Y.

[21] Appl. No.: 909,540

[22] Filed: May 25, 1978

[51] Int. Cl.[2] ..... A63H 29/20

[52] U.S. Cl. ..... 46/209; 46/230

[58] Field of Search ..... 46/230, 209

[56] References Cited

U.S. PATENT DOCUMENTS

| | | | |
|---|---|---|---|
| 2,625,771 | 1/1953 | Hennrick | 46/105 |
| 3,650,067 | 3/1972 | Greenwood | 46/206 |
| 3,698,129 | 10/1972 | Lemelson | 46/209 X |
| 3,955,429 | 5/1976 | Holden | 46/209 |

FOREIGN PATENT DOCUMENTS

| | | | |
|---|---|---|---|
| 880569 | 7/1949 | Fed. Rep. of Germany | 46/230 |
| 708469 | 5/1954 | United Kingdom | 46/230 |

*Primary Examiner*—Charles E. Phillips

*Attorney, Agent, or Firm*—C. Hercus Just

[57] ABSTRACT

A wheeled toy having an inertia type flywheel to drive at least one wheel to propel the toy along a surface after applied force has pushed the toy along a surface sufficient to store kinetic energy in the flywheel, the toy including in the body thereof an electric generating device also driven by said flywheel to activate an auxiliary electrical device on said toy, such as a sounding device, electric light bulb to illuminate the same, or otherwise. The toy also includes a commutator operable to effect intermittent actuation of the auxiliary electric device and thereby cause flashing of the electric bulb when said auxiliary device is an electric bulb.

6 Claims, 9 Drawing Figures

INERTIA WHEEL TOY VEHICLE

BACKGROUND OF THE INVENTION

The employment of inertia type flywheels in many types of toys has existed for a number of years. The flywheel is energized with kinetic energy by manually pushing the toy along a surface to accelerate the rotation of the flywheel and then, upon releasing the toy upon said surface, the energy of the flywheel drives the toy until the energy is expended or until the toy meets an obstruction. For purposes of accommodating this type of motive power to certain types of toys, various arrangements of gear train, as well as different types of means to energize the flywheel, have been employed and particular examples thereof comprise the subject matter of certain patents, as follows:

U.S. Pat. No. 2,625,771 to Herrick, dated Jan. 20, 1953, shows a figure toy which is motorized by means of a flywheel and simple gear train that drives a pair of wheels on a common axle.

U.S. Pat. No. 3,650,067 to Greenwood, dated Mar. 21, 1972, shows a toy automobile in which the flywheel is mounted for rotation about a vertical axis to drive the rear axle which is horizontal and the equivalent of bevel gears are employed to translate the rotation of the vertical axis of the flywheel to the horizontal axis of the rear wheels of the vehicle.

U.S. Pat. No. 3,698,129 to Lemelson, dated Oct. 17, 1972, shows a toy automobile in which the flywheel is mounted for rotation about a horizontal axis and an auxiliary rack is employed to initially rotate the flywheel to store kinetic energy and a clutch is subsequently operated to connect the rotating flywheel to a pair of bevel members, one of which is on at least one of the wheels to drive the same.

U.S. Pat. No. 3,955,429 to Holden, dated May 11, 1976, shows a toy comprising a figure which may be associated, for example, with a toy locomotive, and simulating an engineer, the figure toy being driven by a flywheel operable about a horizontal axis and a pair of gear trains are actuated thereby respectively to drive individual drivewheels supporting the toy figure in one embodiment of the invention, and in a second embodiment, the front wheels on an axle of a toy vehicle are driven by a similar flywheel and gear train.

It also is well-known that many types of toys, including toy automobiles, trains, and the like, have been provided with electric lighting which is energized either by the current derived from a conventional transformer employed in regard to electric toy locomotives, or by batteries carried by the toy vehicles. As far as is known by the present inventor, however, the kinetic energy of a flywheel has not previously been employed in toys for purposes of driving an electric generating device to generate current in situ by the toy to operate auxiliary electric devices, such as sound-producing means, electric light bulbs, or otherwise.

SUMMARY OF THE INVENTION

In view of the foregoing, it is one of the principal objects of the present invention to provide a toy in which a flywheel and gear train are mounted for purposes of propelling the toy along a surface and energy is developed in the flywheel by means of using applied force to push the toy vehicle along a surface to accelerate the rotation of the flywheel and thereby develop various amounts of kinetic energy by which the toy is driven when the same is released for movement along said surface, and a generating device is associated with and driven by the flywheel for purposes of generating electric current by which an auxiliary electric device is activated incident to the toy running along said supporting surface.

It is another object of the invention to provide said auxiliary electric device in the form of an electric bulb of suitable size, whereby the current developed by the generating device illuminates said bulb as the toy vehicle moves along said surface as aforesaid.

A still further object of the invention is to employ a commutator in association with one of the axles of the vehicle and operable to effect a make-and-break circuit to the auxiliary electric device, whereby when, for example, the device is an electric bulb, a flashing light will be generated by the electric power developed by the generating device.

Still another object of the invention is to employ a gear train between the flywheel and the driven axle of the vehicle which is compact and so arranged that it may be enclosed within a small housing suitable for mounting within the body of a toy vehicle, such as a toy automobile, but the ratios of the various gears being such as to develop a very substantial speed differential between the flywheel and said axle for purposes of quickly accelerating the speed of the flywheel when pushing the toy along a supporting surface and, conversely, effecting a substantial driving period for the toy vehicle at a relatively slow speed contrasted with the high speed of the inertia type flywheel.

Details of the foregoing objects and of the invention are set forth in the following specification and illustrated in the accompanying drawings comprising a part thereof.

BRIEF DESCRIPTION OF THE DRAWINGS

Referring to FIGS. 1–3, in particular, the toy vehicle embodying the present invention comprises a body 10 which includes a chassis 12 shown best in FIGS. 2 and 3, and a top body 14, which fits upon the chassis 12 and is connected thereto by any suitable means such as screws 16, as shown in FIG. 1. It is to be understood that the toy vehicle illustrated in the drawings and described in detail hereinafter is intended to be illustrative of a number of different types of toy vehicles which might embody the novel concepts of the invention which primarily are associated with the drive means and an auxiliary electric device of which several kinds are referred to hereinafter.

Figure 1:
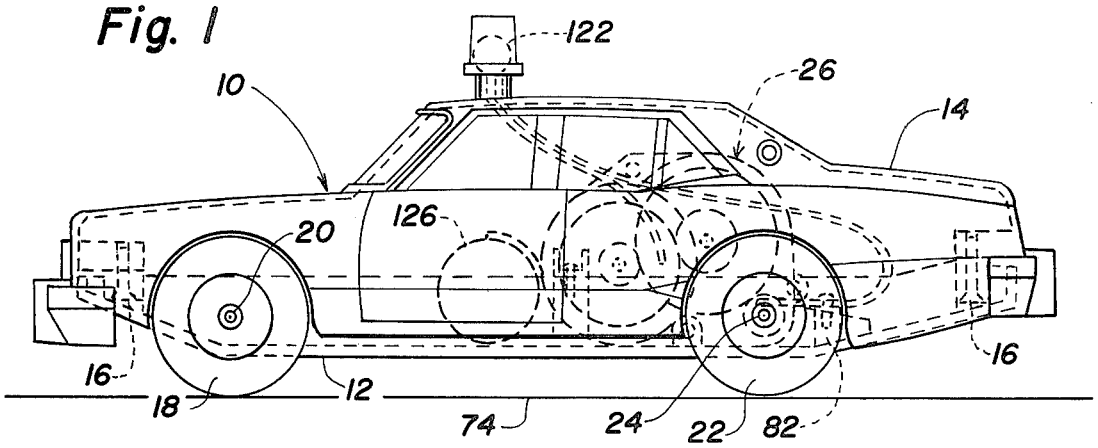
FIG. 1 is a side elevation of an exemplary toy specifically comprising a toy automobile embodying the details of the present invention.

In view of the fact that the invention primarily pertains to means to drive a wheeled toy vehicle of suitable type, it will be seen that the chassis 12 has a pair of front wheels 18 respectively mounted upon the opposite ends of a horizontal axle 20. The rear portion of the chassis 12 also is supported by a pair of rear wheels 22, which respectively are supported on the opposite ends of a transverse rear axle 24. In the specific illustration shown on the drawings, the rear wheels 22 comprise the drive wheels but it is to be understood that if desired for any particular type of toy vehicle to have the front wheels as the drive wheels, this is contemplated within the perview of the invention.

The power or drive means for the toy vehicle comprises a compact unit 26, which preferably is contained within the top body 14. For purposes of support of certain of the elements and especially to prevent the ingress of extraneous matter, it is preferred that said compact unit be enclosed within a suitable housing 28 which, especially to minimize manufacturing costs, may be formed from molded plastics but any other appropriate material, such as cast metal or otherwise, may be used for such housing, if desired. The housing also provides appropriate bearings for supporting the opposite ends of certain shafts, described in detail hereinafter, and the housing preferably comprising two parts 30 and 32, which interfit and preferably are secured together by any suitable means, such as rivets or screws 34, best shown in FIGS. 3 and 4.

Figure 4:
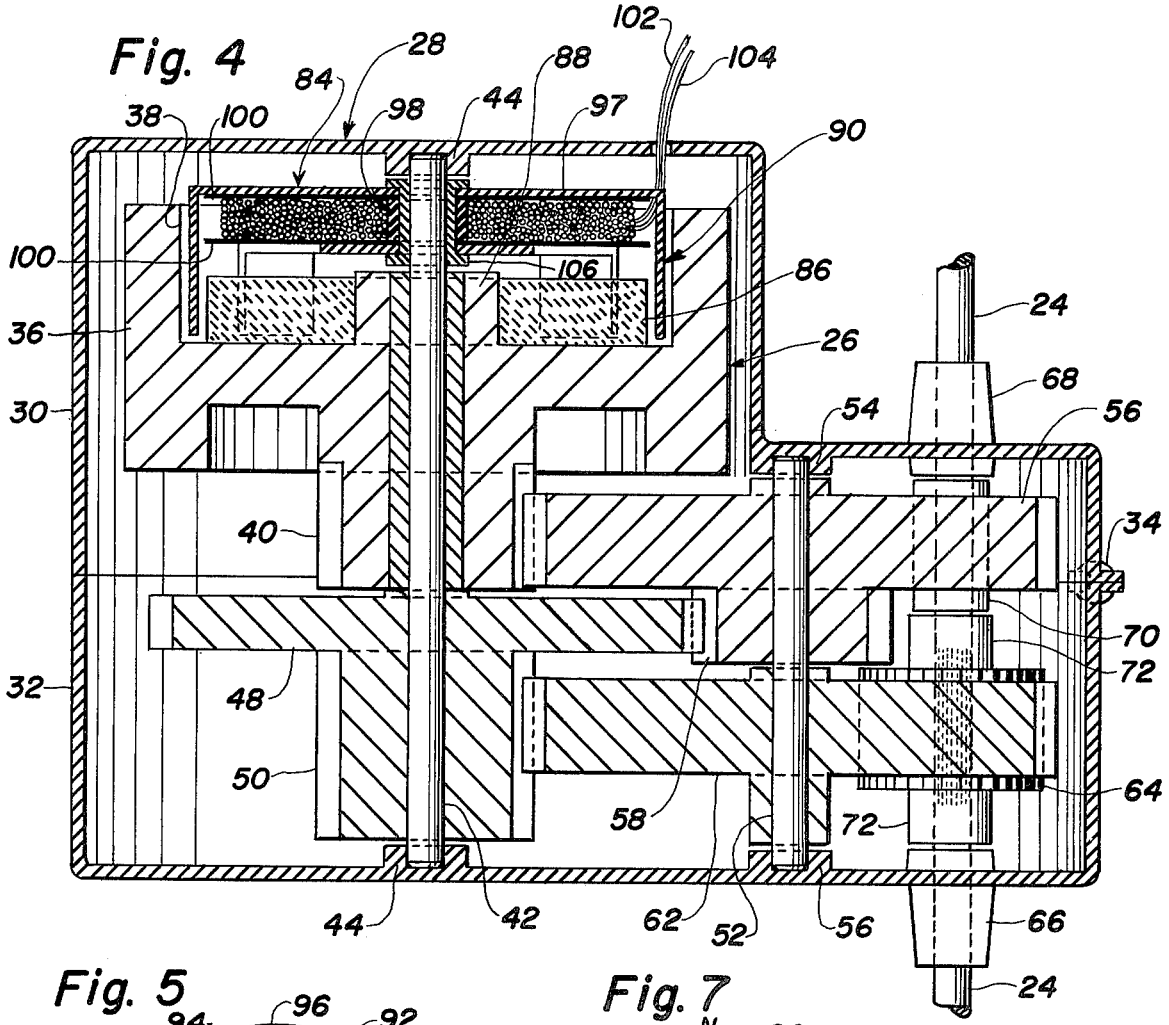
FIG. 4 is a horizontal sectional view on a much larger scale than employed in FIG. 2 and showing details of the flywheel, generating device and gear train in association with the driven axle of the vehicle which is illustrated in fragmentary manner.

The principal power element of the drive means 26 comprises a circular flywheel 36 which has a high specific gravity and may, for example, be cast from suitable white metal or other relatively heavy material. Preferably, one face of the flywheel 36 has a circular cavity 38, which is coaxial with the flywheel, and said flywheel preferably is formed integrally with a pinion gear 40. The flywheel and pinion are rotatably mounted upon a horizontal first shaft 42, which preferably is stationary and is secured within appropriate sockets 44 which are formed on the inner surfaces respectively of the two parts 30 and 32 of housing 28, as best shown in FIG. 4. Also, the flywheel and pinion 36, 40, have an appropriate sleeve bearing 46 integral therewith, the same being formed from an appropriate wear-resistant metal different from that from which the shaft 42 is formed and preferably comprises bronze.

Also mounted upon shaft 42 is a first combination gear and pinion 48, 50, which is freely rotatable upon shaft 42 in the nature of an idler. A second shaft 52, which is shorter than shaft 42, extends between opposite sides of the housing 28 and is either fixed or rotatable within appropriate sockets 54 and 56 formed in the housing parts 30 and 32, as clearly shown in FIG. 4, for purposes of supporting respectively a second combination gear 56 and pinion 58, the gear 56 meshing with pinion 40 on flywheel 36 and the pinion 58 meshing with gear 48 of the first combination gear and pinion.

Also mounted upon shaft 52 is an additional gear 62, which is of the same diameter as gear 56 and meshes with pinion 50 on the first combination gear and pinion 48, 50. Lastly, the above-described gear train includes a single pinion 64, which is fixed to drive shaft 24 upon which the rear wheels 22 are mounted and to which they are fixed so as to be driven thereby. The rear axle 24, incidentally, is supported in appropriate bearings 66 and 68, best shown in FIG. 4. A spacing sleeve 70 also is mounted on rear axle 24 and the opposite ends of the single pinion 64 preferably have apertured bosses 72 projecting in opposite directions therefrom so as to suitably space the single pinion 64 in its desired operative position within the housing 28. Thus far, it will be seen that the gear train extends between the flywheel 36 and the driving axle 24 in a very compact manner and due particularly to the utilization of two combination gear and pinion elements, an extensive difference in speed exists between the flywheel 36 and driven axle 24, which may, for example, be as high as twenty to one. The shafts 42 and 52 are parallel to each other and the driven axle 24.

Figure 2:
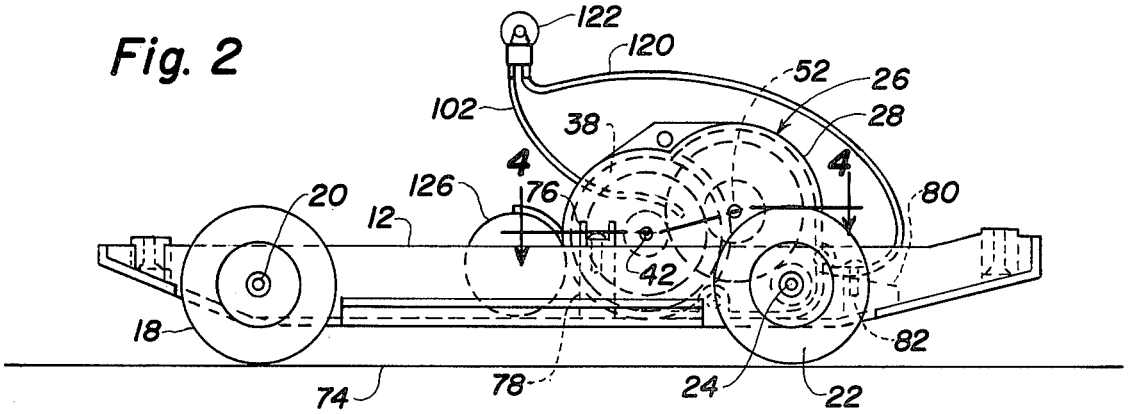
FIG. 2 is a modified view of FIG. 1 and comprises a side elevation of the chassis of the toy vehicle shown in FIG. 1, the body of the vehicle being removed to show the flywheel and gear train in combination with the generating device embodying the principles of the invention.

In operation, the toy vehicle is the type which is driven by kinetic energy induced and stored in the flywheel 36 by pushing the vehicle along its supporting surface 74 which, for example, may be a floor, repeated pushings for short lengths normally being employed for purposes of rapidly accelerating the rotary speed of the flywheel 36 which, when a desired speed has been achieved, the vehicle is released for movement along the supporting surface 74 by means of the kinetic energy then being gradually dissipated from the flywheel incident to driving the rear axle 24 of the vehicle and thus, propel the same for a substantial distance under normal circumstances of use. To effectively support the above-described compact driving unit 26 upon the chassis 12, it will be seen that the housing has short wings 76, which abut projections 78, extending upward from opposite sides of the chassis 12 and appropriate screws, shown in FIGS. 1–3, secure the wings 76 to the projections 78. The rear portion of the housing 28 has an extension 80 which is suitably connected to the floor of the chassis 12, as best shown in FIG. 2. Said floor also has an upstanding additional projection 82 for purposes to be described.

Figure 7:
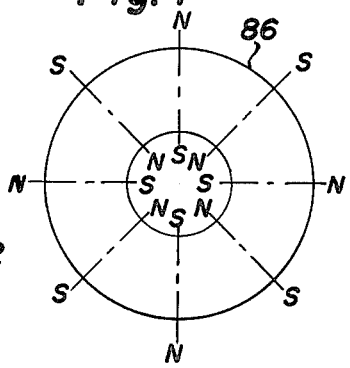
FIG. 7 is an exemplary plan view showing in a scale similar to FIG. 4, a diagrammatic disclosure of the permanent magnet with the magnetic poles indicated thereon.

The principal object of the invention is to utilize the flywheel 36 to develop electric energy and this is accomplished by mounting an electric generating device 84, hereinafter termed a generator, within housing 28. For purposes of compactness, the generator 84 comprises an annular magnet 86, best shown in enlarged plan view in FIG. 7, said magnet preferably being formed from ceramic material, and the specific illustration shown in FIG. 7, discloses that the magnet has eight poles, all positioned 45° with respect to each other and evenly spaced around the circumference of the magnet. Said magnet is mounted within the base of the circular cavity 38 in flywheel 36 and is appropriately secured thereto by cement or any other suitable means. The magnet preferably is coaxial with and fits over a circular boss 88 projecting upward from the base of the circularcavity 38. Coacting with the magnet 86 is a field coil 90, best illustrated in FIGS. 5 and 6, and comprising a pair of cross-shaped metallic members 92 and 94, the outer ends each of the legs of said cross-shaped members being bent at a right angle to provide a plurality of similar pole pieces 96, the outer ends of which are all disposed within a common plane transverse to the axis of the field.

Figure 5:
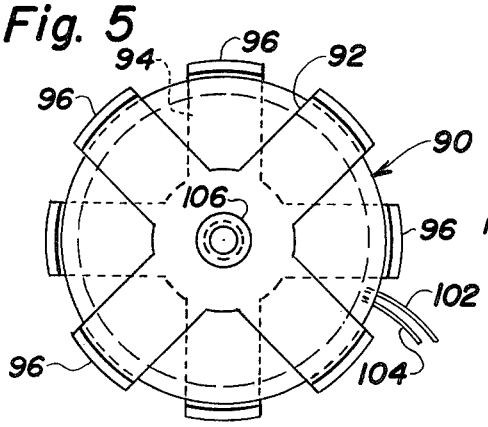
FIG. 5 is a plan view of the field and pole pieces of the generating device on a slightly smaller scale than is used in FIG. 4.
Figure 6:
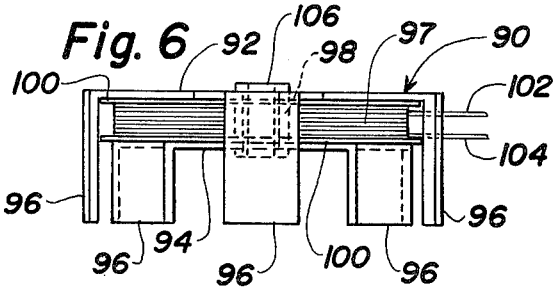
FIG. 6 is a side elevation of the field shown in FIG. 5.

As will be seen from FIG. 5, the pole pieces 96 also are arcuate and are disposed within a common circle, as can be visualized from FIG. 5. Sandwiched between the cross-shaped members 92 and 94 is a wire coil 97, which is wound around a central spacer core 98 of metal and insulating discs 100, made from paper or the like, overlie opposite surfaces of the coil 97 and thereby retain the coil between the cross-shaped metallic members 92 and 94, as best shown in FIGS. 4 and 6.

The opposite ends of the coil 97 comprise lead wires 102 and 104 which comprise part of the electric circuit described hereinafter. The spacer core 98 extends around a central portion of a connecting grommet 106, the opposite radially extending flanges thereof securing the cross-shaped members 92 and 94, insulating discs 100 and coil 97 in sandwiched relationship. Said grommet 106 is stationary with respect to the stationary shaft 42 and may be secured thereto, such as being press-fitted onto the upper end of said shaft as viewed in FIG. 4. Accordingly, in the specific illustration, the circular field 90 is stationary, while the annular magnet 86 of the alternator 84 is rotatable with the flywheel 36. If desired, however, these principal elements of the generator may be reversed by stationarily supporting the annular magnet 86, for example, upon the upper end portion of stationary shaft 42 and connecting the circular field 90 directly to the flywheel 36 for rotation therewith and thereby utilize the relative movement between said field and magnet to generate electic current.

Further in the specific illustration of the drawings and following description, the current produced by the generator 84 is alternating current, commonly designated as A.C. current. Whether the current is alternating or direct depends upon the manner in which the current is introduced to the circuit and the particular design of the generating device.

Figure 3:
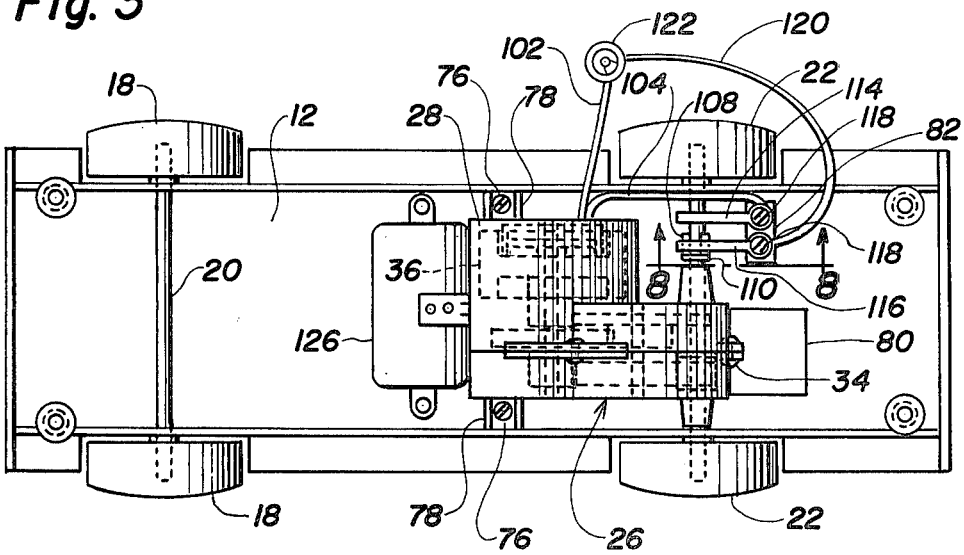
FIG. 3 is a plan view of the structure shown in FIG. 2 and illustrating the exemplary electric bulb and circuit wires extending to one side thereof.
Figure 9:
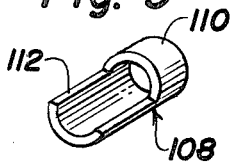
FIG. 9 is a perspective view of the commutator shown in FIG. 8.
Figure 8:
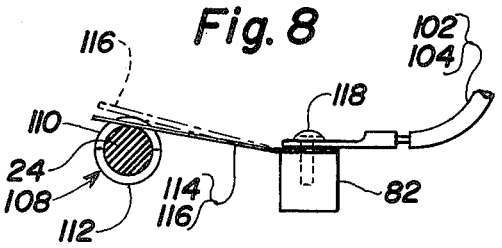
FIG. 8 is a fragmentary vertical section on a larger scale than in FIG. 3, showing details of the commutator as seen on the line 8—8 of FIG. 3.

The present invention illustrates a commutator 108, shown in the plan view of FIG. 3 on a small scale but shown in detail on a larger scale in FIGS. 8 and 9. Said commutator is formed from insulating material, such as plastic, and is relatively thin, the same having a circular hub 110, which is press-fitted to the rear axle 24 for rotation therewith and a semi-circular projection 112 is used for purposes now to be described.

Referring to FIG. 3, it will be seen that a pair of spring contact fingers 114 and 116 are connected for support at one end to additional projection 82 on the floor of the chassis. The outer end of finger 114 slidably rides upon the rotating rear axle 24 at all times to make electrical contact therewith, and the other spring finger 116 makes only sequential contact therewith for purposes of interrupting the flow of current in the circuit comprising the coil leads 102 and 104, one of which is connected to the contact finger 114 by a screw 118 threaded into the projection 82 of insulating material and the contact finger 116 is connected to an additional circuit wire 120.

The lead wire 102 is connected to an auxiliary electric device 122 which is specifically illustrated as an electric light bulb, the same being connected in series between the lead wire 102 and additional circuit wire 120, contact wire 116, the rear axle 24, contact finger 114, and lead wire 104 of the coil. When the contact 116 is in contact with the axle 24 as shown in full lines in FIG. 8, the electric light bulb 122 will be continuously illuminated as the toy vehicle is driven by the flywheel 36. In order to produce a flashing light, however, the commutator projection 112 sequentially raises the contact 116 from engagement with the axle 24, as shown in phantom in FIG. 8, thereby interrupting the circuit and causing the illumination of the electric bulb 122 to cease. However, the speed of successive contacts and disengagements of the contact finger 116 with the rear axle 24 is so rapid that a pulsating or flashing type of illumination is provided.

While the aforementioned auxiliary electric device is specifically illustrated as an electric light bulb, it is to be understood that any other type of electrically-operated device suitable for use on a toy vehicle, for example, such as an appropriate type of sound device emitting a roaring sound, similar to that produced by the engine of a racing car, or a device producing a sound similar to the siren of a police car, or otherwise, may be used, either in conjunction with or as a substitute for, the electric light bulb 122. For example, an exemplary sound-producing unit 126 is shown as comprising a possible additional electrically activated device, which may be of any suitable type, such as those referred to above or otherwise, and the same may be conveniently mounted compactly within the body 14 of the toy vehicle.

From the foregoing, it will be seen that the present invention uses a basic well-known general type of flywheel driven wheeled toy, but an outstanding innovation is provided by employing the flywheel additionally to generate electric current for any of several different auxiliary uses, such as either continuous or flashing light, and/or a sound-producingdevice, all of which is arranged in very compact manner and employing a gear train between the flywheel and the axle, which is specifically designed not only to be very compact, but also produce a very high differential in speed between the flywheel and the driving axle upon which the drivewheels of the vehicle are mounted, thereby permitting the drivewheels initially to be accelerated to very high rates of speed very rapidly prior to releasing the toy for being driven by the kinetic energy stored within the flywheel, and simultaneously generate electric current to activate auxiliary electric devices, which render the toy vehicle much more realistic and thereby affording delight to a child or yound person playing with the toy.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

We claim:

1. A wheeled toy adapted to run along a supporting surface and having a body and at least one current conductible axle rotatably supported thereby with wheels on the ends of said axle, an inertia type flywheel rotatably supported by said body for rotation about a fixed axis, and a speed-changing gear train connected between said flywheel and at least one of the wheels of said toy comprising a drivewheel, said toy when rolled along said supporting surface by applied force rotating said flywheel to store kinetic energy therein and upon release of the toy said stored energy to said flywheel drives at least one wheel of said toy to propel the toy along said surface, in combination with an auxiliary electric device mounted upon said toy, an electric generator connected to said flywheel for operation thereby to generate electric current, said generator comprising a permanent magnet and a field including a coil, one of the latter items being fixedly supported by said body of said toy and the other being connected to said flywheel for rotation therewith relative to said fixedly supported item, a pair of contacts supported upon said body for contact with said axle, and a circuit connecting said auxiliary electric device in series with said contacts and the opposite ends of said coil, whereby electric current generated by said generator is delivered to said auxiliary electric device to activate the same, when said flywheel is rotating said generator to generate electric current.

2. The toy according to claim 1 in which said generator comprises a magnet connected to and rotatable with said flywheel, and a pole-type stator and flat field coil supported stationarily relative to the body of said toy, said stator comprising a pair of cross-shaped metallic members mounted respectively against opposite faces of said coil and the ends of the legs of said members being bent in the same direction from the circumference of said coil to form pole pieces having ends disposed in a common plane, whereby rotation of said magnet by said flywheel generates electric current as aforesaid.

3. The toy according to claim 1 further including a commutator mounted upon said axle and a gear of said gear train also being connected to said axle to drive the same, said commutator having at least a portion of current-insulating material engageable sequentially with said one of said contacts during rotation of said axle and thereby interrupting the flow of current to said auxiliary electric device to render the activation thereof intermittent.

4. The toy according to claim 3 in which said auxiliary electric device is an electric light bulb adapted to be illuminated in flashing manner as said axle of said toy is rotated incident to driving said toy as aforesaid.

5. The toy according to claim 1 in which said body of said toy is a toy vehicle having at least one axle to support at least one of said wheels to comprise a drive-wheel for said toy, a housing mounted within said body and containing at least most of said generator and gear train and said axle extending from said housing, one gear at one end of said gear train being fixed to said axle to drive the same and the gear at the opposite end of said gear train being connected to and coaxial with said flywheel, said gear train being of the speed-increasing type and the arrangement of the gears therein being such as to drive said axle at a substantially lower rotary speed than said flywheel, and said generator comprising relatively rotatable permanent magnet and field members, one of said members being supported by said housing stationarily and the other member being connected to said flywheel for rotation therewith relative to the stationary member to generate electric current to activate said auxiliary electric device.

6. The toy according to claim 5 in which said flywheel has a pinion gear coaxially fixed thereto, a first shaft rotatably supported within said housing and said flywheel being fixedly supported thereon, a first combination coaxial gear and pinion rotatably supported upon said first shaft in close relation to said flywheel and pinion, a second shaft parallel to said first shaft and supported within said housing, a second combination coaxial gear and pinion on said second shaft, an additional gear rotatable on said second shaft closely adjacent said second combination gear and pinion, said axle being parallel to said first and second shafts and having a drive pinion fixed thereto and meshing with said additional gear, said first and second combination gear and pinions intermeshing with each other and respectively with said additional gear and flywheel and pinion, thereby providing a very compact gear train highly suited for use in a small toy vehicle body and capable of producing very high differentials in rotary speeds between said flywheel and axle, the lowest speed being that of said axle.

* * * * *